US006588164B1

(12) United States Patent
Moblo

(10) Patent No.: US 6,588,164 B1
(45) Date of Patent: Jul. 8, 2003

(54) SCREED FORM STAKE

(75) Inventor: Glenn Robert Moblo, 9758 Ellsworth Rd., East Jordan, MI (US) 49727

(73) Assignee: Glenn Robert Moblo, East Jordan, MI (US)

( * ) Notice: Subject to any disclaimer, the term of this patent is extended or adjusted under 35 U.S.C. 154(b) by 0 days.

(21) Appl. No.: 10/074,087

(22) Filed: Feb. 11, 2002

(51) Int. Cl.[7] ..... E04C 3/16; E04F 13/06

(52) U.S. Cl. ..... 52/364; 52/365

(58) Field of Search ..... 52/364, 370, 365; 135/118, 119; 248/508, 679; 411/480; 5/417, 420

(56) References Cited

U.S. PATENT DOCUMENTS 1,212,843 A * 1/1917 Struchen ..... 52/370
2,592,626 A * 4/1952 Wanless ..... 61/48
2,867,041 A * 1/1959 McMillan ..... 33/74
3,280,829 A * 10/1966 Glendenning ..... 135/15
3,451,179 A * 6/1969 Kendzia ..... 52/370
3,935,653 A * 2/1976 Klein ..... 40/125
4,012,159 A * 3/1977 Berry ..... 404/68
4,195,809 A * 4/1980 Morrison ..... 249/205
4,508,319 A * 4/1985 Tappan et al. ..... 256/19
4,533,112 A * 8/1985 Santos ..... 249/3
4,562,672 A * 1/1986 Westplate ..... 52/105
4,572,701 A * 2/1986 Parsons et al. ..... 404/50
4,575,985 A * 3/1986 Eckenrodt ..... 52/677
5,042,958 A * 8/1991 Stenersen ..... 405/184.4
5,173,004 A * 12/1992 Fahrenkrog ..... 404/72
5,230,187 A * 7/1993 Reimann ..... 52/102
5,809,700 A * 9/1998 Roush et al. ..... 52/4
5,852,895 A * 12/1998 Sinanan ..... 47/33
5,881,495 A * 3/1999 Clark ..... 47/48.5
6,021,600 A * 2/2000 Everett ..... 47/33
6,161,360 A * 12/2000 Smith ..... 52/678
6,461,084 B1 * 10/2002 Stuart ..... 405/244

* cited by examiner

*Primary Examiner*—Leslie A. Braun
*Assistant Examiner*—Amy J. Sterling
(74) *Attorney, Agent, or Firm*—Reising, Ethington, Barnes, Kisselle and Learman, P.C.

(57) ABSTRACT

The screed form stake has a cradle portion with a horizontal top surface. A screed rod groove in the top surface extends from a front wall to a rear wall of the cradle portion. First and second side flanges extend downward from the cradle portion and have rear flange surfaces in a first vertical plane. A central flange is integral with the first and second side flanges, extends downward from the cradle portion, and extends forward from the first and second side flanges. A soil penetration point is formed on the bottom of the screed stake between the side flanges and the central flange. A stake driver has a bottom surface, that engages the stake top wall, and a top surface. A screed rod shaped member on the bottom of the stake driver is seated in the screed rod groove and has an exposed elevation measuring surface.

9 Claims, 3 Drawing Sheets

SCREED FORM STAKE

FIELD OF THE INVENTION

The present invention pertains to the field of devices for use in concrete pouring operations. Particularly, the invention relates to screed form stakes used in concrete pouring operation to ensure that once the is poured it is smooth and level.

BACKGROUND OF THE INVENTION

Screed and form stakes are conventionally used when pouring concrete in order to obtain the proper grade and to ensure a smooth level surface of the concrete once it has been poured. Form stakes are used to support concrete forms or barriers which are used along the outside of an area in which concrete is to be poured, so as to contain the poured concrete in that area. Screed stakes are used to support rods or bars, which are placed over large areas to ensure that the. concrete being poured is level and smooth.

On many smaller jobs individuals have taken to forming screed stakes from wooden scraps. These scraps are formed into stakes which are then used to support either concrete forms or screed rods/bars. This process is time consuming and often does not yield accurate results.

Alternatively, the use of complex screed systems is expensive, especially given the fact that, in many operations, screed stakes may permanently stay in the concrete once it has been poured. One solution to this problem used in the prior art was a multiple piece screed stake, part of which could be removed. An example of this type of system is illustrated in U.S. Pat. Nos. 2,867,041 and 5,173,004. These systems, while effective, are more complex and costly than the screed system of the present invention. Further, the prior art systems are more complicated to use and generally require more than one individual to ensure proper placement of the stakes over a given area.

SUMMARY OF THE INVENTION

The present invention is A SCREED/FORM STAKE SYSTEM comprised of a screed/form stake (10) and a stake driver (12). The screed/form stake (10) has a lower end, which is adapted for ground cutting by terminating in the shape of a point. The upper end of the screed/form stake (10) comprises a U-shaped cradle portion (14) adapted for receiving a screed rod or bar [(28) in FIG. 6]. The stake has two side flanges (16, 18), which together form the face portion of the stake. Holes (26) are drilled in each of the side flanges (16, 18) at predetermined positions. The holes (26) are for use in association with a concrete form and to assist in the proper placement of the stake in a screeding operation. A central raised flange (20) is located on the face portion of the stake: The central flange (20) extends upwardly from the lower end of the stake where it is angled to cooperate with the pointed end of the face portion of the stake. The central flange (20) extends upwardly terminating in the raised U-shaped cradle portion (14) of the upper end of the stake (10). The stake may be of varying lengths, depending upon the depth of concrete to be poured. The stake driver (12) comprises a handle portion and a driver portion and is designed to mate with the screed/form stake (10) in use.

BRIEF DESCRIPTION OF THE DRAWINGS

The presently preferred embodiment of the invention is disclosed in the following description and in the accompanying drawings, wherein.

DESCRIPTION OF PREFERRED EMBODIMENT

The Screed/Form Stake System of the present invention comprises a stake 10, which may function either as a screed stake or as a form stake, and a stake driver 12.

Figure 6:
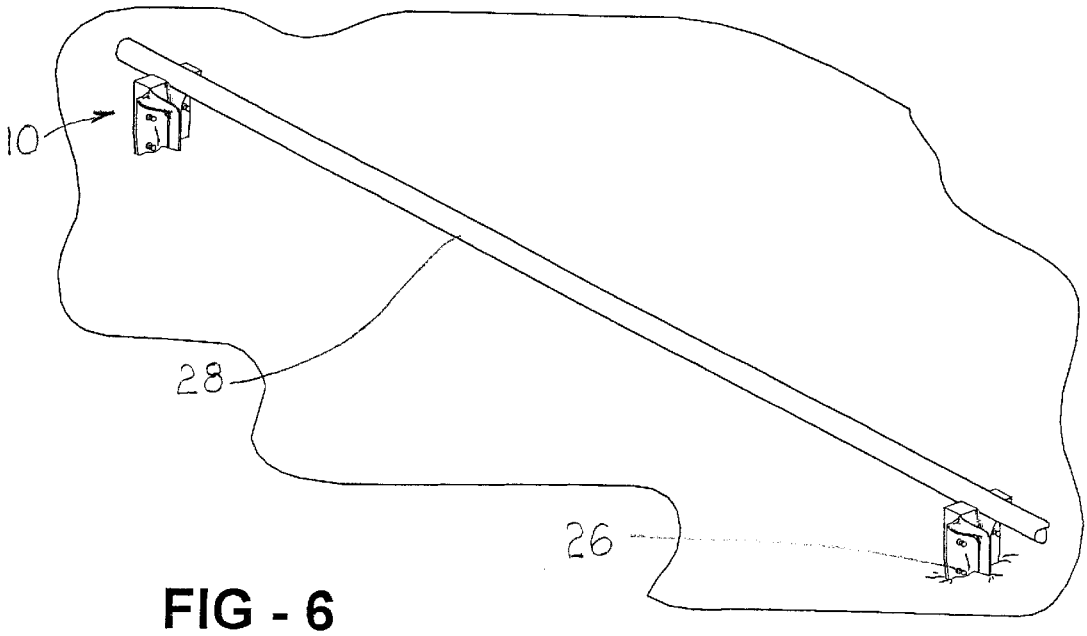
FIG. 6 shows the screed/form stake of the present invention being used as a screed stake in association with screed bars or rods.

The Screed/Form Stake 10 when being used in a screeding operation (as seen in FIG. 6) supports the bars or rods 28 that are used to determine the height of concrete when being poured over large areas. The bars or rods 28 are placed in the U-shaped cradle portion 14 at the upper end of the stake 10. In a screeding operation, the flanges on the stake are important in securing the stake in the ground. The side flanges 16, 18 prevent front to back movement while the raised center flange 20 prevents lateral movement. The side flanges 16 and 18 have rear surfaces 19 and 21. The central flange 20 is angled at the lower end so as to cooperate with the lower end of the face portion for facilitating entry into the ground. A first gusset 32 in the junction between the first side flange 16 and the central flange 20 and a second gusset 34 between the second side flange 18 and the central flange strengthen the three flanges. The gussets 32 and 34 also strengthen the connections between the cradle portion 14 and the flanges 16, 18 and 20.

Figure 5:
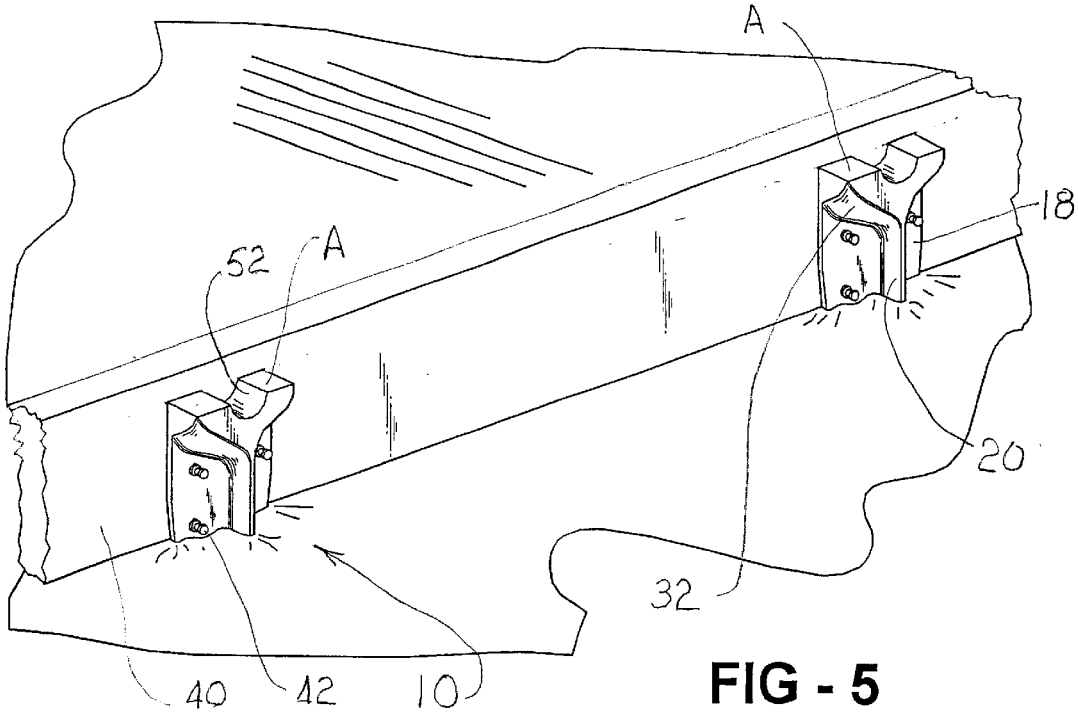
FIG. 5 shows the screed/form stake of the present invention being used as a form stake.

When used as a form stake (as shown in FIG. 5) the stake supports barrier walls or forms 40, which contain the concrete as it is being poured in a given area. The stake is fastened to the form by fasteners 42 that pass through holes 26 in the side flanges 16, 18 which taken together form the face portion of the stake. These holes 26 are spaced at predetermined distances along the side flanges 16 and 18. The holes 26 allow the side flanges to be secured to a form. They also help guide placement of the stake when being used as a screed stake. The holes 26 receive conventional screws, nails or other conventional fasteners 42 and allow the stake to be securely fastened to the form 40.

In either use, the stake terminates at a point 44 at a lower end. The pointed lower portion 44 of the stake 10 facilitates entry of the stake into the ground.

Figure 1:
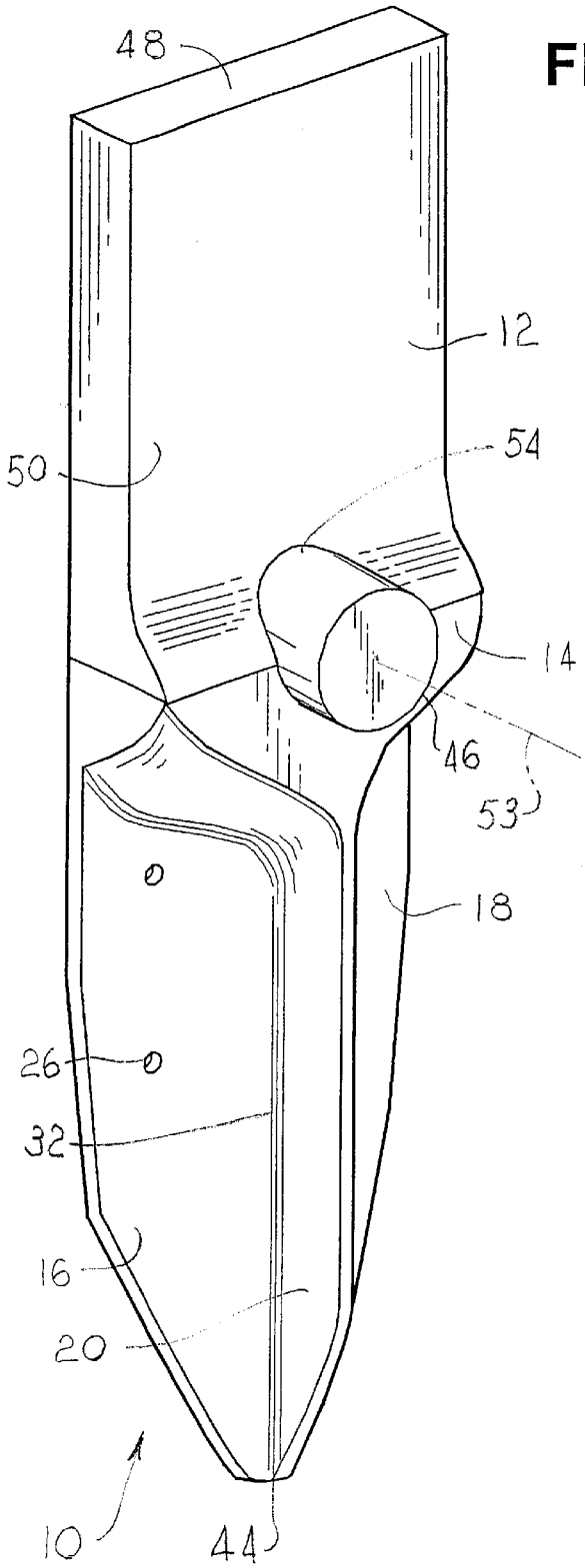
FIG. 1 is a perspective view of the screed system of the present invention showing the screed/form stake and the stake driver in engaged relationship.
Figure 2:
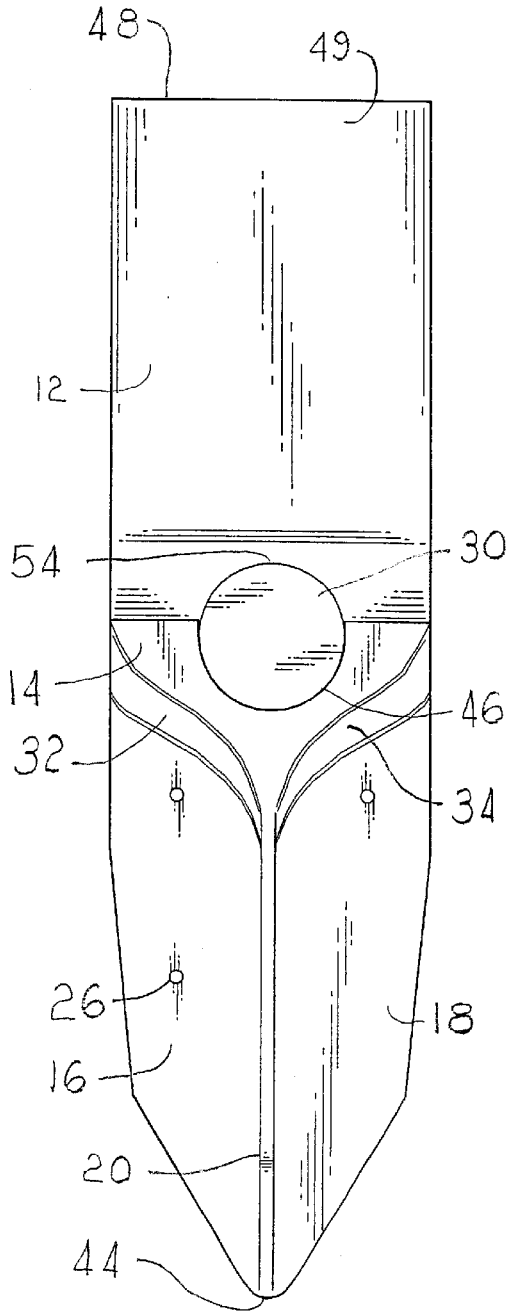
FIG. 2 is a front elevational view of the screed system of the present invention showing the screed/form stake and stake driver in engaged relationship.
Figure 3:
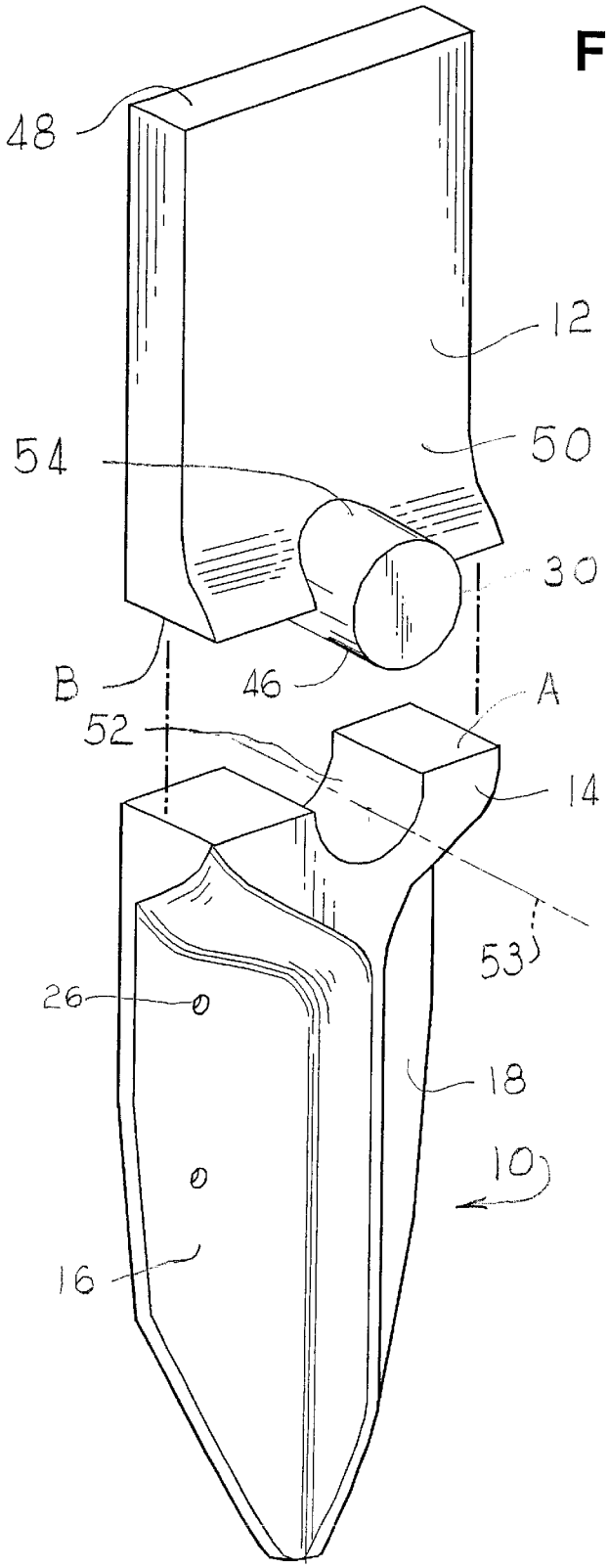
FIG. 3 is an extended perspective view of the screed system of the present invention showing the screed/form stake and stake driver separated.
Figure 4:
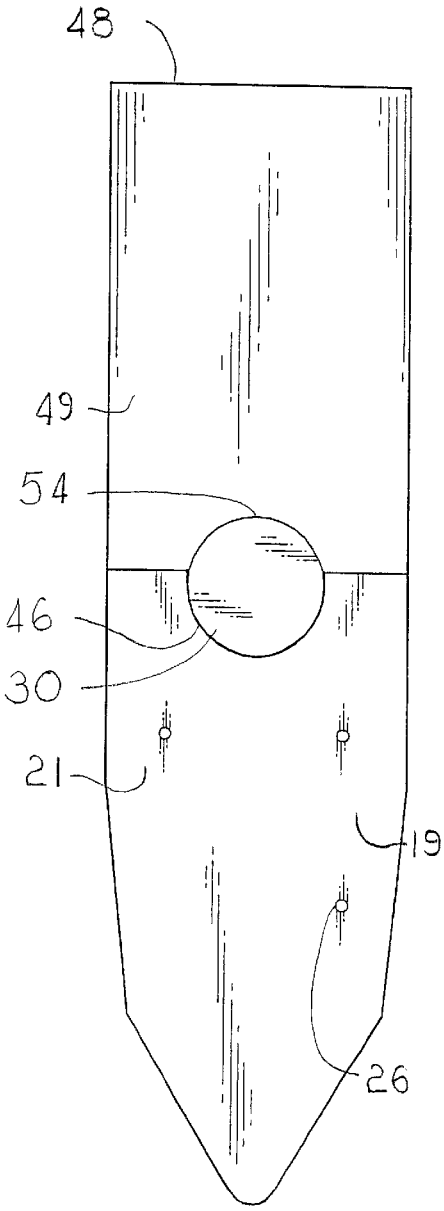
FIG. 4 is a rear view of the screed/form system of the present invention showing the screed/form stake and stake driver in engaged relationship.

The upper portion of the stake is formed into a U-shaped cradle portion 14 for receiving screed bars or rods 28, which are used as guides when pouring concrete over large areas. The U-shaped cradle portion 14 also receives the round portion 46 of the stake driver 12 when the stake 10 is being pounded into the ground. As seen in FIG. 3, the upper face "A" of the cradle portion 14 is of essentially the same size and shape as the portion marked "B" on the stake driver 12. This design allows for even distribution of the forces when the stake driver is being used to drive the stake into the ground. The cradle portion 14 is disposed on the face of the stake 10 and is formed of such a thickness so as to prevent breaking when being driven into the ground by the stake driver 12.

The stake driver 12 is designed to mate with the stake 10 while in use. The upper end portion 48 of the stake driver 12 may be of any shape that allows for the use of a device (such as a hammer) to exert force on the stake driver and thereby pound the stake 10 into the ground. The round portion 30 of the stake driver is flush with the back of the stake driver 12 and extends outwardly from the front 50 of the driver. The stake driver 12 may also be designed having the round portion 30 extending outwardly from the back 49 and front 50 of the driver. The round portion 30 of the driver must extend outwardly from at least one side of the stake driver because this portion of the driver serves two functions. First, it mates with the U-shaped cradle portion 14 of the stake 10 and the screed rod groove 52 thereby aiding the driver's 12 function of forcing the stake 10 into the ground. Second, the round portion 30 is designed to be of the same diameter as conventional screed rods or bars 28, thereby aiding in the level placement of the screed bars or rods on the stake once the stake has been driven into place. The screed rod groove 52 has a groove axis 53 that is coaxial with the axis of the round portion 30 when the round portion is seated in the screed rod groove. The groove axis 53 is perpendicular to the rear surface 19 and 21. Essentially, the outwardly extending round portion 30 has a screed rod elevation measuring surface 54 that serves as a platform for a transit and transit stick or other measuring system. The transit stick may be placed on the top measuring surface 54 of the outwardly extending round portion 30, which will be the same height as the stake 10 with a screed rod or bar 28 placed thereupon. Thus, the proper height of the stake 10 and whether it is level, may be determined without the need for placement of the actual screed rods or bars 28 and may be accomplished by one individual.

The screed/form stake system may be made of any material suitable for withstanding the forces necessary to drive the stake 10 into the ground, including plastic, wood and metal, among others. Presently, it is believed that the most economical material for manufacturing the stake is plastic. However, other materials may be used so long as they are sufficiently strong to withstand the forces transmitted by the stake driver 12.

The disclosed embodiment is representative of a presently preferred form of the invention, but is intended to be illustrative rather than definitive thereof. The invention is defined in the claims.

What is claimed is:

1. A screed form stake comprising a cradle portion with a rear cradle wall having a vertical rear cradle wall surface in a first plane, a front cradle wall, a left cradle side wall, a right cradle side wall, and a stake top wall; a screed rod groove in the stake top wall of the cradle portion that extends from the front cradle wall to the rear cradle wall and having a groove axis that is perpendicular to the first plane; a first side flange integral with the cradle portion, extending downward from the cradle portion, and having a first flange rear surface in the first plane; a second side flange integral with the cradle portion and the first side flange, extending downward from the cradle portion and having a second flange rear surface that is in the first plane; a central flange integral with the cradle portion, the first side flange and the second side flange, extending downward from the cradle portion, and extending forward from the first side flange and the second side flange; a soil penetration point on said screed form stake at a bottom of a joint between the first side flange, the second side flange and the central flange; a first gusset, at the junction between the first side flange and the central flange, extending from the soil penetration point to the cradle portion; a second gusset, at the junction between the second side flange and the central flange, extending from the soil penetration point to the cradle portion; a stake driver having a stake driver bottom that engages the stake top wall; a stake driver top surface; and a screed rod shaped member, embedded in the stake driver, that seats in the screed rod groove and extends out of at least one end of said stake driver to expose a screed rod elevation measuring surface.

2. A screed form stake in combination with a stake driver wherein said screed form stake includes a cradle portion with a rear cradle wall having a vertical rear cradle wall surface in a first plane, a front cradle wall, a left cradle side wall, a right cradle side wall, and a stake top wall; a screed rod groove in the stake top wall of the cradle portion extending from the front cradle wall to the rear cradle wall and having a groove axis that is perpendicular to the first plane; a first side flange integral with the cradle portion, extending downward from the cradle portion, and having a first flange rear surface in the first plane; a second side flange integral with the cradle portion and the first side flange, extending downward from the cradle portion and having a second flange rear surface that is in the first plane; a central flange integral with the cradle portion, the first side flange and the second side flange, extending downward from the cradle portion, and extending forward from the first side flange and the second side flange; a soil penetration point on said screed form stake at a bottom of a joint between the first side flange, the second said flange and the central flange; and wherein said stake driver has a stake driver bottom that engages the stake top wall; a stake driver top surface; and a screed rod shaped member, embedded in the stake driver bottom, that seats in the screed rod groove and extends out of at least one end of said stake driver to expose a screed rod elevation measuring surface.

3. A screed form stake in combination with a stake driver, as set forth in claim 2, wherein the stake top wall is a flat surface bisected by the screed rod groove.

4. A screed form stake in combination with a stake driver, as set forth in claim 2, wherein the screed rod groove includes an arcuate surface with a constant radius from the groove axis.

5. A screed form stake in combination with a stake drive as set forth in claim 2, including:

a first gusset at the junction between the first side flange and the central flange and extending from the soil penetration point to the cradle portion; and a second gusset at the junction between the second side flange and the central flange and extending from the soil penetration point to the cradle portion.

6. A screed form stake in combination with a stake driver, as set forth in claim 2, including a plurality of form attaching fastener passages through the first side flange and the second side flange.

7. A screed form stake in combination with a stake driver, as set forth in claim 2, including a screed rod supported in the screed rod grooves of a plurality of said screed form stakes and having a round screed rod cross-section.

8. A method of forming a surface on new concrete with a selected elevation at known locations comprising:

positioning a plurality of screed stakes, each having a screed rod positioning groove in a stake top surface and a bottom soil penetration point , in selected vertical positions; seating a screed rod shaped member, embedded in the bottom of a stake driver, in each screed rod position groove; transferring force through the stake driver to the plurality of screed stakes; driving the screed stakes into the soil until the screed rod shape member in the stake driver has a screed rod elevation measuring surface at a selected elevation; removing the stake driver from each screed stake; mounting screed rods in the plurality of screed rod positioning grooves; pouring fresh concrete around the screed stakes and over the screed rods; finishing a surface of the fresh concrete at a level even with the tops of the screed rods; removing the screed rods; and filling the voids where the screed rods were located with fresh concrete.

9. A screed form stake comprising a cradle portion with a rear cradle wall having a vertical rear cradle wall surface in a first plane, a front cradle wall, a left cradle side wall, a right cradle side wall, and a stake top wall; a screed rod groove in the stake top wall of the cradle portion that extends from the front cradle wall to the rear cradle wall and having a groove axis that is perpendicular to the first plane; a left force impact top wall surface extending from the vertical rear cradle wall surface to the front cradle wall and from said screed rod groove to the left cradle side wall, a right force impact top wall surface extending from the vertical rear cradle wall surface to the front cradle wall and from said screed rod groove to the right cradle side wall, and wherein force for driving the screed form stake into soil is applied simultaneously to the left force impact top wall surface, to the right force impact top wall surface and to said screed rod groove; a first side flange integral with the cradle portion, extending downward from the cradle portion, and having a first flange rear surface in the first plane; a second side flange integral with the cradle portion and the first side flange, extending downward from the cradle portion and having a second flange rear surface that is in the first plane; a central flange integral with the cradle portion, the first side flange and the second side flange, extending downward from the cradle portion, and extending forward from the first side flange and the second side flange; a soil penetration point on said screed form stake at a bottom of a joint between the first side flange, the second side flange and the central flange; a first gusset, at the junction between the first side flange and the central flange, extending from the soil penetration point to the cradle portion; a second gusset, at the junction between the second side flange and the central flange, extending from the soil penetration point to the cradle position; and wherein the vertical rear cradle wall surface, the first flange rear surface and the second flange rear surface are the rear extent of said screed form stake.

* * * * *